US008918965B2

(12) United States Patent
Kaltenrieder

(10) Patent No.: US 8,918,965 B2
(45) Date of Patent: Dec. 30, 2014

(54) BRACELET CLASP

(75) Inventor: Cédric Kaltenrieder, Bienne (CH)

(73) Assignee: The Swatch Group Management Services AG, Bienne (CH)

( * ) Notice: Subject to any disclaimer, the term of this patent is extended or adjusted under 35 U.S.C. 154(b) by 371 days.

(21) Appl. No.: 13/414,190

(22) Filed: Mar. 7, 2012

(65) Prior Publication Data

US 2012/0240359 A1 Sep. 27, 2012

(30) Foreign Application Priority Data

Mar. 21, 2011 (EP) ..... 11159072

(51) Int. Cl.
*A44C 5/18* (2006.01)
*A44C 5/24* (2006.01)

(52) U.S. Cl.
CPC ..... *A44C 5/24* (2013.01)
USPC ..... 24/71 J; 24/256 WS; 24/68 J

(58) Field of Classification Search
CPC ..... A44C 5/24; A44C 5/14; A44C 5/145; A44C 5/2042; A44C 5/22; A44C 5/12; G04B 39/02
USPC ..... 24/68 J, 70 J, 71 J, 265 WS; 63/3.1, 9; 368/292
See application file for complete search history.

(56) References Cited

U.S. PATENT DOCUMENTS

| | | | | |
|---|---|---|---|---|
| 1,832,734 | A * | 11/1931 | Prestinari | 24/71 R |
| 4,330,905 | A * | 5/1982 | Wolfgang | 24/71 J |
| 4,675,955 | A * | 6/1987 | Nakamura | 24/656 |
| 5,781,968 | A * | 7/1998 | Widmer | 24/71 J |
| 6,023,816 | A * | 2/2000 | Okada et al. | 24/71 J |
| 6,094,782 | A * | 8/2000 | Gay et al. | 24/71 J |
| 6,119,315 | A * | 9/2000 | Gay | 24/68 J |
| 6,175,729 | B1 * | 1/2001 | He et al. | 455/344 |
| 6,185,799 | B1 * | 2/2001 | Gay | 24/715 |
| 6,308,382 | B1 * | 10/2001 | Takahashi et al. | 24/265 WS |
| 6,434,798 | B1 * | 8/2002 | Yamakawa et al. | 24/71 J |
| 6,588,069 | B2 * | 7/2003 | Deriaz et al. | 24/265 WS |
| 6,944,916 | B2 * | 9/2005 | Kawagoe | 24/71 J |
| 7,124,478 | B2 * | 10/2006 | Aquillon et al. | 24/265 WS |
| 7,412,755 | B2 * | 8/2008 | Tetu et al. | 24/71 J |
| 7,797,801 | B2 * | 9/2010 | Takahashi | 24/265 WS |
| 7,926,150 | B2 * | 4/2011 | Robert et al. | 24/71 J |
| 8,561,263 | B2 * | 10/2013 | Catanese | 24/71 J |
| 8,739,369 | B2 * | 6/2014 | Kaltenrieder et al. | 24/71 J |
| 8,789,245 | B2 * | 7/2014 | Leger | 24/71 J |
| 8,789,246 | B2 * | 7/2014 | Yliluoma et al. | 24/265 EC |
| 2007/0125123 | A1 * | 6/2007 | Sierro | 63/3.2 |

(Continued)

FOREIGN PATENT DOCUMENTS

| | | | |
|---|---|---|---|
| CH | 698 628 | A2 | 9/2009 |
| JP | 07-289316 | A | 11/1995 |
| JP | 10-005015 | A | 1/1998 |

*Primary Examiner* — Victor Batson
*Assistant Examiner* — Jason W San
(74) *Attorney, Agent, or Firm* — Sughrue Mion, PLLC

(57) ABSTRACT

The bracelet clasp includes first (1) and second (2) hinged arms and a cover (3). The clasp is provided with two push-pieces (15*a* and 15*b*). A safety device prevents the clasp opening when pressure (A-B) is simultaneously exerted both on a push-piece (15*a*) and on one side of the cover opposite said push-piece. This device may be a strut (70) provided with extended portions (72, 73) abutting on both sides of the first arm (1).

4 Claims, 4 Drawing Sheets

(56) References Cited

U.S. PATENT DOCUMENTS

2009/0133438 A1* 5/2009 Stampfli et al. ..... 63/3.1
2014/0059818 A1* 3/2014 Catanese et al. ..... 24/71 J
2014/0150223 A1* 6/2014 Kaltenrieder et al. ..... 24/71 J
2014/0223705 A1* 8/2014 Catanese ..... 24/71 J

* cited by examiner

BRACELET CLASP

This application claims priority from European Patent Application No. 11159072.5 filed Mar. 21, 2011, the entire disclosure of which is incorporated herein by reference.

FIELD OF THE INVENTION

The present invention relates to a bracelet clasp comprising at least two arms hinged to each other, a first rigid arm provided with two side portions, one end of said first arm being attached to a bracelet strand, the other end being hinged on a first end of a second unfolding arm from which first and second bars extend, the free ends of said bars being traversed by an arbor about which there is hinged a cover, provided with first and second flaps, to which another bracelet strand is attached, first and second push-pieces which being integral with or fixed to said first and second bars and which precede the place where said bars are traversed by said arbor, and a locking mechanism arranged to keep the second arm coupled or handled to the first when no pressure is simultaneously exerted on both push-pieces.

BACKGROUND OF THE INVENTION

A clasp which generally answers the description that has just been given is disclosed in U.S. Pat. No. 1,832,734 (Prestinari). This clasp also has a cover and two push-pieces whose axis of extension does not merge with the axis of articulation of the cover. However, the description given is not sufficiently explicit to explain the security provided by this clasp, namely whether it is absolutely necessary to simultaneously press on both push-pieces in order to open said clasp, or whether pressure on a single push-piece, accompanied by simultaneous pressure on one side of the cover opposite the push-piece, leads to the same result, which is absolutely prohibited in the view of the Applicant of the present invention.

SUMMARY OF THE INVENTION

Thus, in addition to satisfying the generic definition set out in the first paragraph of this description, the present invention is characterized in that the clasp includes a safety device which prevents a lateral movement of the cover causing the clasp to unlock when pressure is simultaneously applied both to a push-piece and to a flap a lateral wall of the cover opposite said push-piece.

BRIEF DESCRIPTION OF THE DRAWINGS

The features and advantages of the present invention will appear from the following description, given with reference to the annexed drawings, and providing, by way of explanatory, but non-limiting example, two advantageous embodiments of a clasp. In the drawings.

DETAILED DESCRIPTION OF THE PREFERRED EMBODIMENTS

Drawings 1 to 8 relate to a first embodiment of the clasp made according to the invention. The first embodiment will now be explained in detail.

Figure 2:
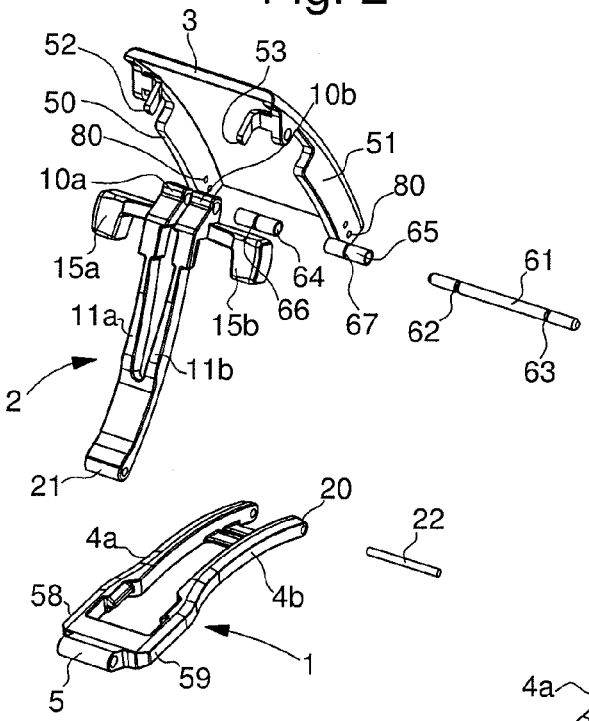
FIG. 2 is an exploded perspective view of the clasp of FIG. 1 showing the various elements of which it is formed.
Figure 1:
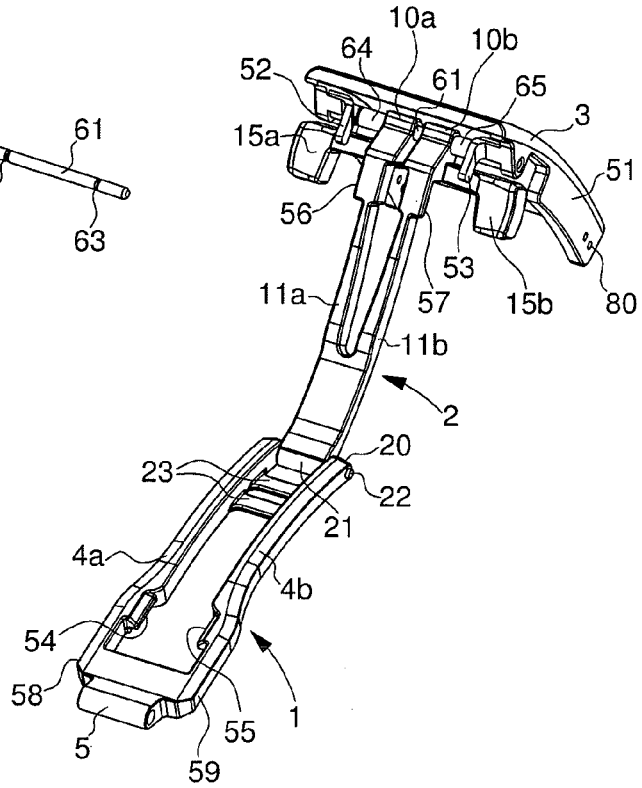
FIG. 1 is a perspective view of a first embodiment of the clasp of the invention shown in the unfolded position.

FIGS. 1 and 2 are perspective views of the bracelet clasp which includes a first rigid arm 1, provided with two side portions 4*a* and 4*b*. The end 5 of this arm is arranged to receive a bracelet strand and takes the form of a bridge connecting the two side portions. The other end 20 of side portions 4*a* and 4*b* is traversed by an arbor 22 about which a first end 21 of a second unfolding arm 2 is hinged. In proximity to this hinge, it is observed that the side portions are joined by bridges 23 which ensure, on the one hand, a good level of rigidity for first arm 1, and which are used, on the other hand, as a stop for the second arm when it is folded into the first arm. First and second bars 11*a* and 11*b* extend from the first end 21 of second arm 2. Said bars have free ends 10*a* and 10*b* through which an arbor 61 passes. About this arbor 61, there is hinged a cover 3, provided with first and second flaps 50 and 51, which have holes 80 for receiving a lug, the starting point for another bracelet strand. FIGS. 1 and 2 also show first and second push-pieces 15*a* and 15*b* which are integral with the first and second bars 11*a* and 11*b*. It will be noted that these push-pieces are not placed in the alignment of arbor 61 passing through the free ends of the bars, but precede said alignment. A locking mechanism is arranged to keep the second arm 2 coupled to the first arm 1 when no pressure is simultaneously exerted on push-pieces 15*a* and 15*b*. For this purpose, side portions 4*a* and 4*b* of first arm 1 respectively carry fixed hooks 54 and 55, respectively arranged to receive hooks 56 and 57 which are fitted to the movable ends of bars 11*a* and 11*b*. This coupling is particularly well shown in the cross-section of FIG. 5.

With respect to the foregoing, which is in principle known from the prior art documents, the clasp of the present invention is characterized by a remarkable and original arrangement in that it includes a safety device preventing a lateral movement of cover 3 causing any inadvertent unlocking of the clasp when pressure is simultaneously applied both to a push-piece and to a flap of the cover 3 opposite said push-piece.

FIGS. 1 to 8 illustrate a first embodiment of this safety device. These Figures show that the arbor passing through the free ends 10*a* and 10*b* of the first and second bars 11*a* and 11*b* and about which cover 3 is hinged is a pin 61 provided with first and second notches 62 and 63. These notches are respectively arranged to retain first and second tubes 64 and 65, each provided with a constricted portion 66 and 67. These retaining tubes are arranged between the free ends 10*a* and 10*b* of bars 11*a* and 11*b* and the first and second flaps 50 and 51 of cover 3.

The actual safety device takes the form of first and second raised ears 52 and 53 in cover 3, these ears forming stop members and abutting on both sides of the first rigid arm 1, when the clasp is in the closing position.

Figure 3:
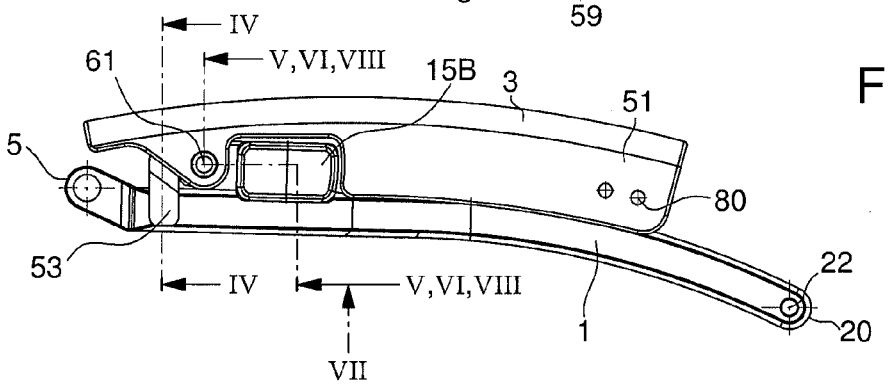
FIG. 3 is a side view of the clasp of FIG. 1 in a closed position.

With reference to the cross-sections of FIGS. 4, 5, 6 and 8 taken in the side view of FIG. 3, the way in which the safety device operates will now be shown.

Figure 4:
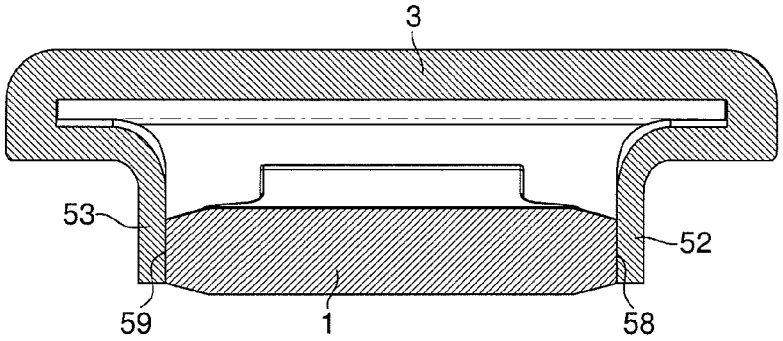
FIG. 4 is a cross-section along the line IV-IV of FIG. 3.

FIG. 4 is a cross-section along the line IV-IV of FIG. 3. It is seen that two ears 52 and 53 are raised in cover 3, also visible in the perspective views of FIGS. 1 and 2. When the clasp is folded as in FIG. 3, ear 52 abuts on the side 58 of first arm 1 and the same is true for ear 53, which abuts on the side 59 of arm 1, these sides 58 and 59 being clearly shown in FIGS. 1 and 2.

Figure 5:
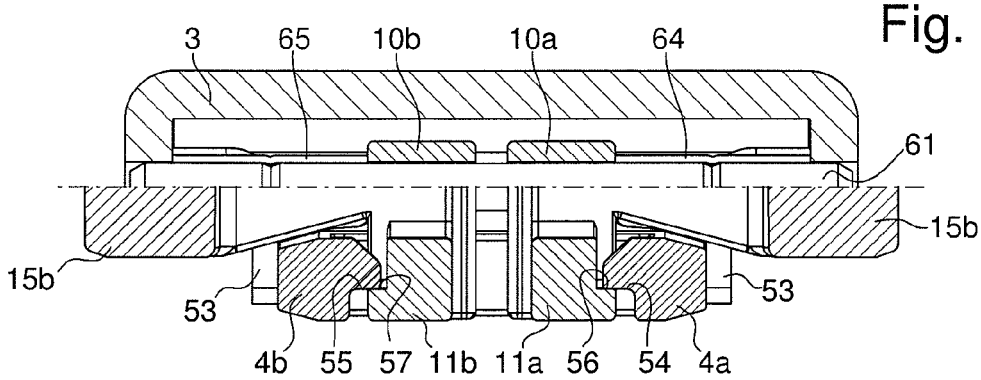
FIG. 5 is a cross-section along the line V-V of FIG. 3 with the clasp closed and locked and the push-pieces not actuated.

FIG. 5 is a cross-section along the line V-V of FIG. 3. Push-pieces 15*a* and 15*b* are not actuated and the locking of the clasp is shown, with hooks 54 and 55 of side portions 4*a* and 4*b* respectively mounted on hooks 56 and 57 of bars 11*a* and 11*b*.

Figure 6:
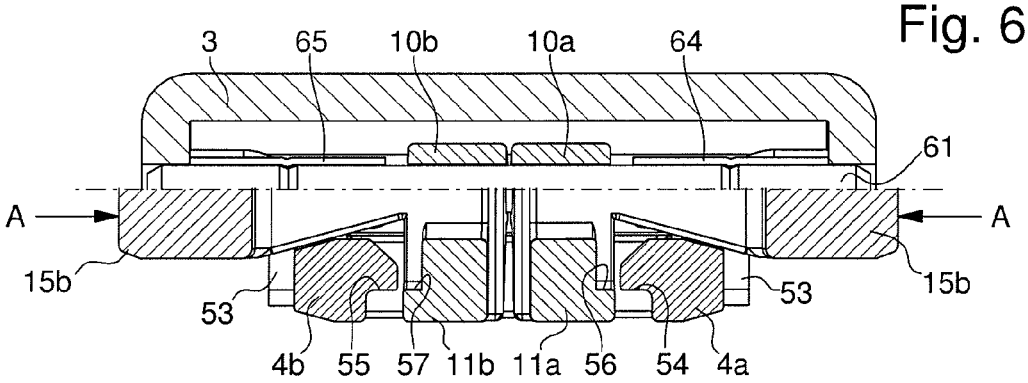
FIG. 6 is a cross-section along the line VI-VI of FIG. 3 with the clasp unlocked and the push-pieces actuated in the direction of arrows A-A.
Figure 7:
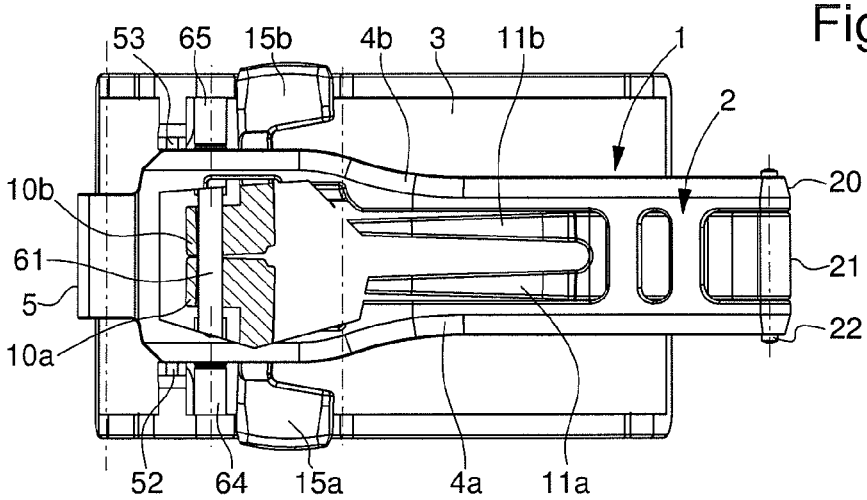
FIG. 7 is a bottom view along the arrow VII of FIG. 3, with the push-pieces actuated in the direction of arrows A-A shown in FIG. 6.

FIG. 6 is a cross-section along the line VI-VI of FIG. 3. The push-pieces are actuated in the direction of arrows A-A. The clasp is unlocked, bars 11*a* and 11*b* being moved closer to each other, releasing their respective hook 56 and 57 from hooks 54 and 55 of side portions 4*a* and 4*b* of rigid arm 1. The same situation is shown in FIG. 7, which is a bottom view along the arrow VII of FIG. 3. Here it is seen that the ends 10*a* and 10*b* of bars 11*a* and 11*b* reach a stop, which prevents any plastic deformation of the bars.

Figure 8:
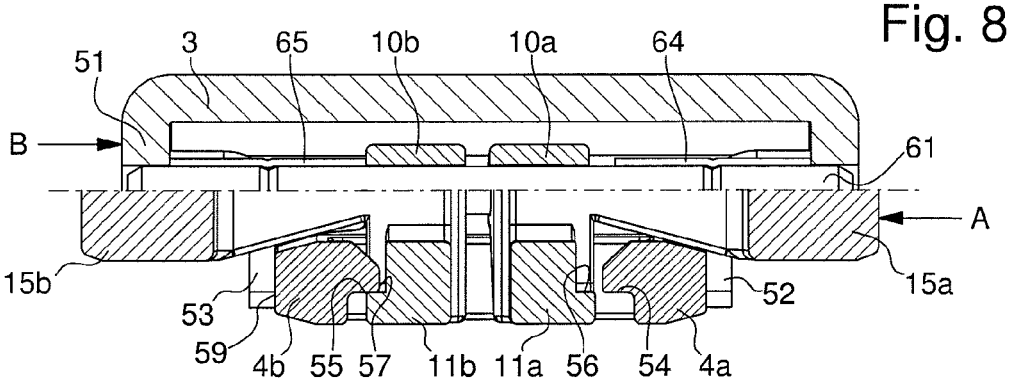
FIG. 8 is a cross-section along the line VIII-VIII of FIG. 3, with the right push-piece actuated in the direction of arrow A and the cover subjected to pressure in the direction of arrow B.

FIG. 8 is a cross-section along the line VIII-VIII of FIG. 3. The right push-piece 15*a* is actuated in the direction of arrow A. Hook 56 of bar 11*a* is released from hook 54 of side portion 4*a*. Instead of exerting an identical pressure on the left push-piece 15*b*, this pressure is exerted on the left of cover 3 in the direction of arrow B. This pressure does not in any way cause the left part of the clasp to unlock, owing to the safety device that has been fitted. Here this device is the left ear 53 (see also FIG. 7) which abuts, in the closed position of the clasp, against the rigid part 59 of first arm 1 located on the side of side portion 4*b*. It will be clear that if ear 53 did not exist, the pressure B exerted on the left of cover 3 would cause the cover to move towards the right. Flap 51 of the cover would then push tube 65 and the free end 10*b* of bar 11*b* in the same direction, thereby causing hooks 55 and 57 to be released and the clasp to be opened. It is clear that the same situation would occur if the left push-piece 15*b* were activated and pressure were exerted on the right side of cover 3. In such case, it would be ear 52 which was active. In conclusion, in order to open the clasp, pressure must be simultaneously exerted on both push-pieces, and any pressure exerted on the cover has no effect.

FIGS. 9 to 15 relate to a second embodiment of the clasp made according to the invention. This second embodiment will now be explained in detail.

Figure 9:
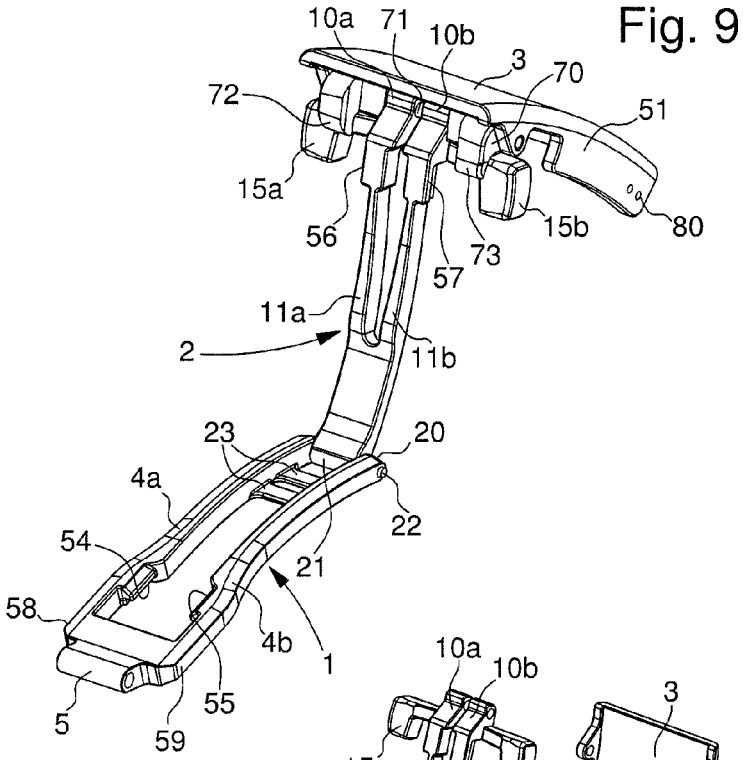
FIG. 9 is a perspective view of a second embodiment of the clasp of the invention shown in the unfolded position.
Figure 10:
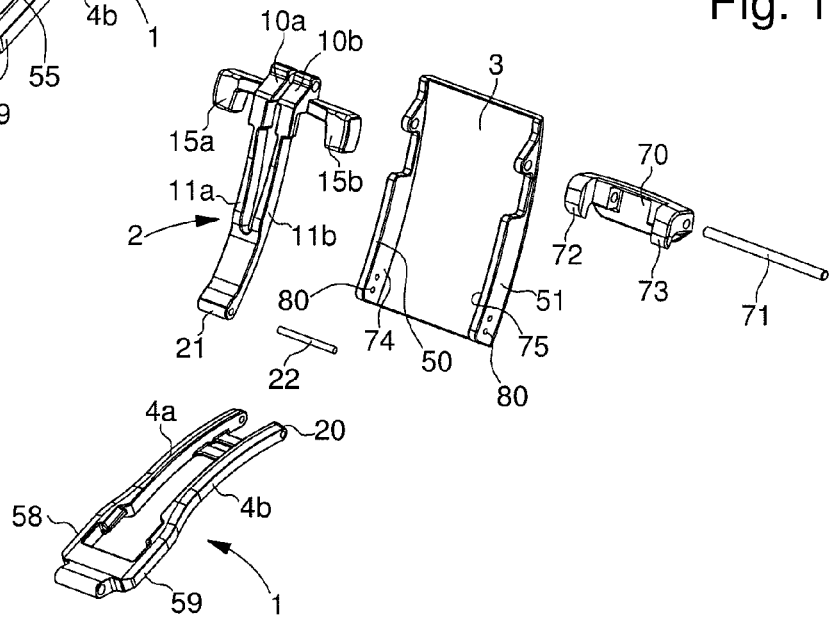
FIG. 10 is an exploded perspective view of the clasp of FIG. 9 showing the various elements of which it is formed.

FIGS. 9 and 10 are perspective views of the bracelet clasp which includes a first rigid arm 1, provided with two side portions 4*a* and 4*b*. The end 5 of this arm is arranged to receive a bracelet strand and takes the form of a bridge connecting the two side portions. The other end 20 of side portions 4*a* and 4*b* is traversed by an arbor 22 about which a first end 21 of a second unfolding arm 2 is hinged. In proximity to this hinge, it is observed that the side portions are joined by bridges 23 which ensure, on the one hand, a good level of rigidity for first arm 1, and which are used, on the other hand, as a stop for the second arm when it is folded into the first arm. First and second bars 11*a* and 11*b* extend from the first end 21 of second arm 2. Said bars have free ends 10*a* and 10*b* through which an arbor 71 passes. About this arbor 71, there is hinged a cover 3, provided with first and second flaps or side walls 50 and 51 which have holes 80 for receiving a lug, the starting point for another bracelet strand. FIGS. 9 and 10 also show first and second push-pieces 15*a* and 15*b* which are integral with or fixed to the first and second bars 11*a* and 11*b*. It will be noted that these push-pieces are not placed in the alignment of arbor 71 passing through the free ends of the bars, but precede said alignment. A locking mechanism is arranged to keep the second arm 2 coupled to the first arm 1 when no pressure is simultaneously exerted on push-pieces 15*a* and 15*b*. For this purpose, side portions 4*a* and 4*b* of first arm 1 respectively carry fixed hooks 54 and 55, respectively arranged to receive hooks 56 and 57 which are fitted to the movable ends of bars 11*a* and 11*b*. This coupling is particularly well shown in the cross-section of FIG. 12.

With respect to the foregoing, which is in principle known from the prior art documents, the clasp of the present invention is characterized by a remarkable and original arrangement in that it includes a safety device preventing a lateral movement of cover 3 causing any inadvertent unlocking of the clasp when pressure is simultaneously applied both to a push-piece and to a flap of the cover 3 opposite said push-piece.

FIGS. 9 to 15 illustrate a second embodiment of this safety device. These Figures show that the arbor passing through the free ends 10*a* and 10*b* of the first and second bars 11*a* and 11*b* and about which cover 3 is hinged is a pin 71, driven into a strut or spacer 70 abutting on both sides on the internal walls 74 and 75 of the first and second flaps 50 and 51 of cover 3.

The actual safety device takes the form of first and second extended portions 72 and 73 which extend from strut 70 and form stop members, abutting on both sides of the first rigid arm 1 when the clasp is in the closing position.

Figure 11:
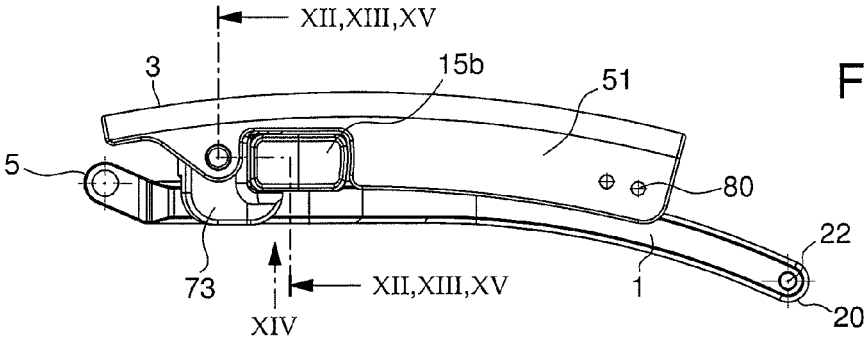
FIG. 11 is a side view of the clasp of FIG. 9 in a closed position.
Figure 12:
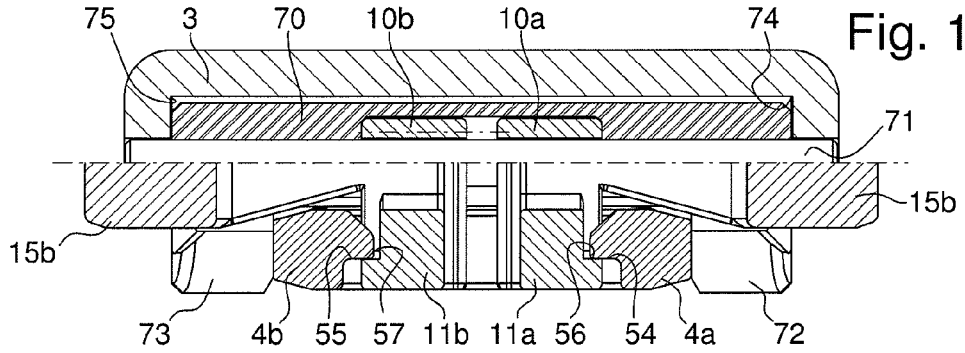
FIG. 12 is a cross-section along the line XII-XII of FIG. 11 with the clasp locked and the push-pieces not actuated.
Figure 13:
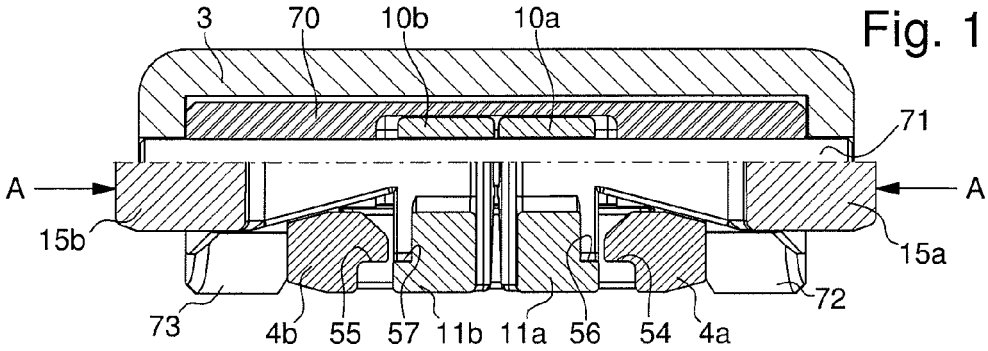
FIG. 13 is a cross-section along the line XIII-XIII of FIG. 11 with the clasp unlocked and the push-pieces actuated in the direction of arrows A-A.
Figure 15:
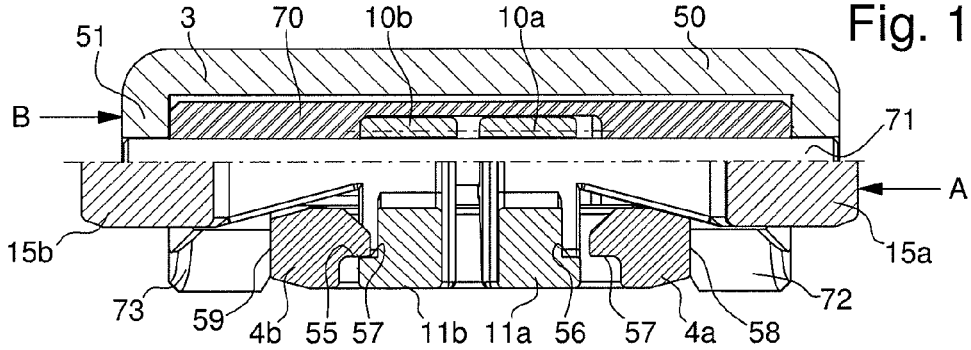
FIG. 15 is a cross-section along the line XV-XV of FIG. 11, with the right push-piece actuated in the direction of arrow A and the cover subjected to pressure in the direction of arrow B.

With reference to the FIGS. 12, 13 and 15 taken in the side view of FIG. 11, the way in which this safety device operates will now be shown.

FIG. 12 is a cross-section along the line XII-XII of FIG. 11. Push-pieces 15*a* and 15*b* are not actuated. The clasp is locked and hooks 54 and 55 of side portions 4*a* and 4*b* are respectively mounted on hooks 56 and 57 of bars 11*a* and 11*b*.

Figure 14:
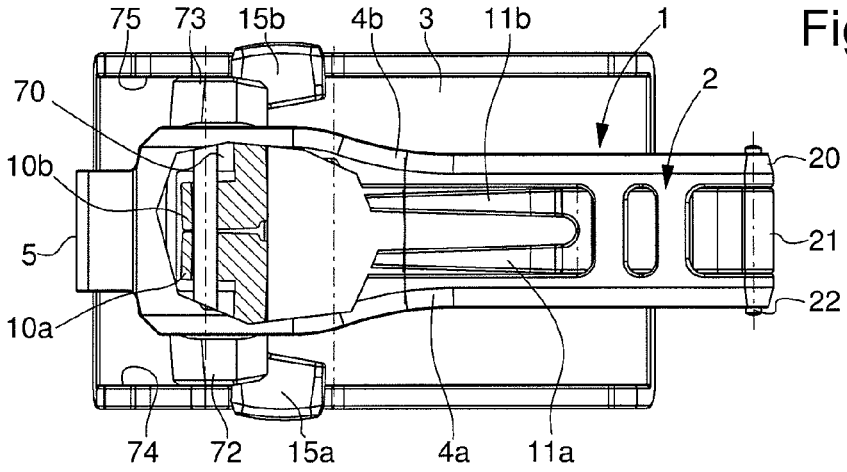
FIG. 14 is a bottom view along the arrow XIV of FIG. 11, with the push-pieces actuated in the direction of arrows A-A shown in FIG. 13.

FIG. 13 is a cross-section along the line XIII-XIII of FIG. 11. Push-pieces 15*a* and 15*b* are actuated in the direction of arrows A-A. The clasp is unlocked and bars 11*a* and 11*b* have moved closer to each other releasing their respective hook 56 and 57 from hooks 54 and 55 of side portions 4*a* and 4*b* of rigid arm 1. The same situation is shown in FIG. 14, which is a bottom view along the arrow XIV of FIG. 11. Here it is seen that the ends 10*a* and 10*b* of bars 11*a* and 11*b* reach a stop, which prevents any plastic deformation of the bars.

FIG. 15 is a cross-section along the line XV-XV of FIG. 11. The right push-piece 15*a* is actuated in the direction of arrow A. Hook 56 of bar 11*a* is released from hook 54 of side portion 4*a*. Instead of exerting an identical pressure on the left push-piece 15*b*, pressure is exerted on the left of cover 3 in the direction of arrow B. This pressure does not in any way cause the left part of the clasp to unlock, owing to the safety device that has been fitted. Here this device is the left extended portion 73 (see also FIG. 14) which abuts in the closed position of the clasp against the rigid portion 59 of first arm 1 located on the side of side portion 4*b*. It will be understood that if the extended portion 73 did not exist, the pressure B exerted on the left of the cover 3 would cause the cover to move towards the right. Flap 51 of cover 3 would then push strut 70 (which has no extended portion) and the free end 10*b* of bar 11*b* in the same direction thereby causing hooks 55 and 57 to be released and the clasp to open. It is clear that the same situation would occur if the left push-piece 15*b* were activated and pressure were exerted on the right side of cover 3. In such case, extended portion 72 would be active. Thus, as in the preceding embodiment, simultaneous pressure must be exerted on both push-pieces to open the clasp and pressure exerted on the cover has no effect.

The invention which has just been described in detail allows implementation of a very light cover 3 made by cutting and folding a metal. The first and second arms 1 and 2 may be made by MIM (metal injection molding).

What is claimed is:

1. A bracelet clasp including:

at least two arms hinged to each other, a first rigid arm fitted with two side portions, one end of said first arm being attached to a bracelet strand, the other end being hinged to a first end of a second unfolding arm from which there extend first and second bars, said first and second bars each having a free end at a distance from said first end, said free ends of said first and second bars being traversed by an arbor;

a cover being hinged about said arbor, provided with first and second flaps to which another bracelet strand is attached;

first and second push-pieces integral with or fixed to said first and second bars, wherein said first and second push-pieces are arranged between said arbor and said first end of said second unfolding arm, wherein said first and second push-pieces extend through said first and second flaps respectively and project therefrom;

a locking mechanism arranged to keep the second arm coupled to the first arm when no pressure is simultaneously exerted on said first and second push-pieces, wherein said locking mechanism includes catching elements on mutually facing sides of said side portions and said bars; and a safety device which prevents a lateral movement of the cover from causing the locking mechanism to unlock when pressure is simultaneously exerted both one of said first or second push-pieces and on one of said first or second flaps of the cover opposite said one of said first or second push-pieces undergoing said pressure, between said free ends and said first and second flaps of the cover, wherein said safety device includes first and second raised ears in the cover, said ears forming stop members and abutting on both sides of said first rigid arm when said clasp is in the closing position.

2. The clasp according to claim 1, wherein the arbor passing through the free ends of the first and second bars a pin, said pin being provided with first and second notches; arranged to retain first and second tubes, each of the first and second tubes being provided with a constricted portion, penetrating in said first and second notches respectively, said tubes being arranged between said free ends and said first and second flaps of the cover.

3. The clasp according to claim 1, wherein the arbor passing through the free ends of the first and second bars a pin, driven into a strut abutting on both sides on the internal walls of the first and second flaps of the cover, and wherein the safety device consists of first and second extended portions extending from said strut, said extended portions forming stop members and abutting on both sides of the first rigid arm when the clasp is in the closing position.

4. The clasp according to claim 1, wherein the first and second arms are made by metal injection molding and wherein the cover is made of cut and folded metal.

* * * * *